US005148620A

United States Patent [19]

Nelson

[11] Patent Number: 5,148,620

[45] Date of Patent: Sep. 22, 1992

[54] SHOTSHELL SIZE ADAPTER

[76] Inventor: Brian Nelson, 6900 Balcom Ave., Reseda, Calif. 91325

[21] Appl. No.: 609,559

[22] Filed: Nov. 6, 1990

[51] Int. Cl.[5] ..... F41A 21/10

[52] U.S. Cl. ..... 42/77; 411/436

[58] Field of Search ..... 42/77; 89/29; 411/436, 411/411, 414

[56] References Cited

U.S. PATENT DOCUMENTS

| | | | |
|---|---|---|---|
| 252,241 | 1/1882 | Morris | 42/77 |
| 2,641,860 | 10/1949 | Dial | 42/77 |
| 2,786,415 | 6/1951 | Alderson | 42/77 |
| 3,196,569 | 6/1964 | Thomason | 42/77 |
| 3,339,394 | 9/1967 | Knode, Jr. et al. | 42/77 |
| 3,384,989 | 7/1966 | Thomas | 42/77 |
| 3,997,995 | 12/1976 | Hicks et al. | 42/77 |
| 4,126,954 | 11/1978 | Plummer | 42/77 |
| 4,404,765 | 9/1983 | Reudelsterz et al. | 42/77 |
| 4,648,192 | 3/1987 | Harness | 42/77 |

FOREIGN PATENT DOCUMENTS

| | | | |
|---|---|---|---|
| 0920472 | 11/1954 | Fed. Rep. of Germany | 42/77 |
| 2704695 | 8/1978 | Fed. Rep. of Germany | 42/77 |
| 0279655 | 3/1952 | Switzerland | 42/77 |
| 0600284 | 3/1976 | Switzerland | 42/77 |

*Primary Examiner*—Michael J. Carone

*Attorney, Agent, or Firm*—John J. Posta, Jr.

[57] ABSTRACT

The shotshell size adapter fits into the breech of a shot gun, gas gun, grenade launcher or other gun and enables the gun to accept various sizes of shotshells and/or cartridges. The adapter includes a cylindrical mainbody which is inserted into the breech bore and a barrel which extends forwardly thereof into the gun barrel bore. The adapter barrel is releasably connected to the main body of the adapter by threads, preferably with rectangular, non-stripping lands and grooves, or by a turn wing and slot arrangement. Preferably, the front portion of the main body bore is recessed so that when the barrel is in place in the main body the bores of the main body and barrel abut each other and are concentric and of the same diameter. Alternatively, the barrel bore can be tapered to act as a shot choke. The rear end of the main body has an annular groove concentric with the main body bore and spaced outwardly therefrom to provide a finger space for lifting a shotshell or cartridge case from the main body bore.

2 Claims, 1 Drawing Sheet

SHOTSHELL SIZE ADAPTER

BACKGROUND OF THE INVENTION

1. Field of the Invention

The present invention generally relates to guns and more particularly relates to an improved shotshell size adapter which includes a detachable barrel and means for easy insertion and removal of a shotshell from a gun.

2. Prior Art

Various devices have been proposed for adapting a gun to accept shells or cartridges of various calibers. It would be desirable, for example, to be able to use, for target practice and for generally familiarizing one with a certain type of weapon, to use less expensive smaller ammunition. For example, in training S.W.A.T. teams on 37mm and 40mm gas guns/ grenade launchers, it would be desirable to be able to fit the gun with means for accepting 12-guage or other guage shotshells instead of the expensive 37mm and 40mm ammunition.

Several attempts have been made in the past to, in effect, downsize guns.

Most of such devices comprise adapters which fit solely within the breech of the gun. See, for example, U.S. Pat. Nos. 3,196,569; 3,997,995; 4,404,765; and 4,126,954. Certain of such adapters have extensions permanently mounted thereon which fit into the gun barrel. See, for example, U.S. Pat. Nos. 2,641,860; 3,384,989; and 4,648,192.

However, there are certain occasions when it is desired to provide a varied shot pattern of pellets emanating from a shotgun; that is, to be able to vary the size and/or length of the adapter extension quickly and easily. Heretofore, no shotshell adapter has been able to provide rapid positive substitution of one adapter extension for another.

It would also be desirable to be able to provide an adapter configuration which could facilitate rapid and easy insertion of a shotshell into the adapter and equally rapid and easy removal thereof from the adapter. This is particularly useful in extensive target practice when a large number of shotshells are fired sequentially over a relatively short period of time. Conventional adapters do not provide for easy insertion and removal of shotshells.

SUMMARY OF THE INVENTION

The improved shotshell size adapter of the present invention satisfies all the foregoing objects, need and desires. The adapter is substantially as set forth in the Abstract of the Disclosure. Thus, the adapter fits into the breech of a shotgun or other gun and enables the gun to accept various sizes of shells or cartridges. The adapter comprises a cylindrical main body which is inserted into the breech bore, and a bored barrel which extends forwardly thereof into the gun barrel bore and is quickly releasably connected to the main body by preferably non-stripping threads, having rectangular lands and grooves, or by a turn wing and slot arrangement.

The front portion of the main body is recessed at the bore to receive the barrel extension (which may be of any length or bore) so that the bores abut and preferably are of the same diameter. Alternatively, the barrel can be of a different diameter and/or tapered.

The rear end of the main body has an annular groove concentric with the bore and spaced outwardly therefrom to provide a finger space for lifting a shotshell or cartridge case from the main body bore. The adapter is simple, provides quickly interchangeable main body and barrel extension sizes for a variety of gun uses and configurations and has improved ease of use.

Further features of the invention are set forth in the following detailed description and accompanying drawings.

DRAWINGS

DETAILED DESCRIPTION

FIGS. 1 & 2

Figure 1:
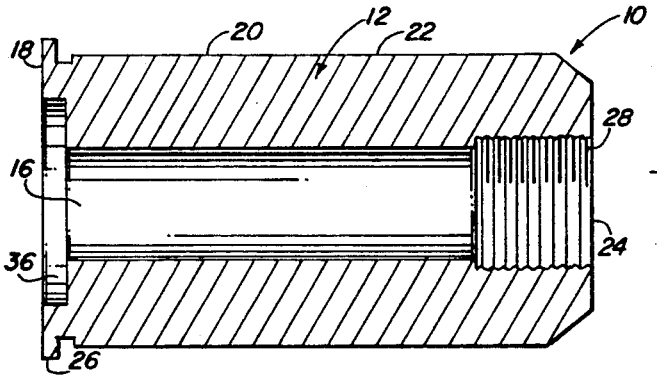
FIG. 1 is a schematic vertical cross-section of a first preferred embodiment of the main body portion of the adapter of the present invention.
Figure 2:
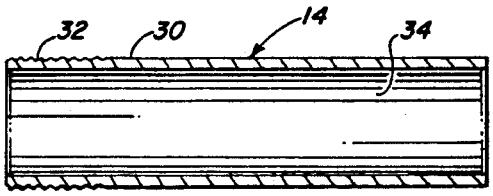
FIG. 2 is a schematic vertical cross-section of a first preferred embodiment of the barrel extension used with the main body of FIG. 1.

Now referring more particularly to FIGS. 1 and 2 of the drawings, a first preferred embodiment of the improved shotshell size adapter of the present invention is schematically depicted therein. Thus, adapter 10 is shown, comprising an elongated cylindrical main body 12 of metal, ceramic, cermet, heavy duty plastic or the like durable material (FIG. 1) and a cylindrical extension barrel 14 of metal or the like. Main body 12 has a cylindrical bore 16 along and concentric with the longitudinal axis thereof extending from rear end 18 of body 12 through rear portion 20 and on into front portion 22 thereof, exiting at front end 24 thereof.

Main body 12 has a rear outwardly extending annular rim 26 adapted to abut the breech of a shotgun, and an expanded recess 28 in portion 22 of bore 16, extending to front end 24 and adapted to threadingly receive the rear portion 30 of barrel 14, the outer surface 32 of which is also threaded.

Barrel 14 has a cylindrical bore 34 which is of the same diameter as bore 16 and is aligned along the longitudinal axis of barrel 14. Barrel 14 may be of any desired length, e.g., 2, 4, 6, 8, 10 or 12 inches long, so as to control the pattern of pellet shot from a gun in which adapter 10 is installed.

Main body 12 slides into the breech bore of the gun (not shown), reducing the size of the ammunition to be shot therefrom. Bore 16 has an expanded rear end 36 to seat flush the expanded rim of a shotshell. Adapter 10 is used with barrel 14 releasably threaded into portion 22 of main body 12 so that bores 16 and 34 abut and are essentially continuous.

Barrel 14 extends out of the gun breech into the barrel of the gun. Barrel 14 has a relatively small threaded area for quick connection and disconnection, and can be made in various tapered and untapered lengths to fit various desired shot patterns. Adapter 10 with main body 12 and barrel 14 screwed together can be rapidly and easily inserted into and seated in the breech of the gun and then is immediately ready for use.

As an example, of the present inventions, adapter 10 has been made in a size to accept 12 gauge shotgun shells to be fired from a 37mm gas gun. Various lengths of barrel 14 were employed with 2.75 inch length 12 guage shells. A 4 inch barrel 14 using 00 buck shot in the shell left a 2'×2'pattern at 30 feet. An 8 inch barrel 14 using the same shot left a 4"—4"pattern at 30 feet. Thus, various patterns of shot can be easily provided by adapter 10.

FIGS. 3 & 4

Figure 3:
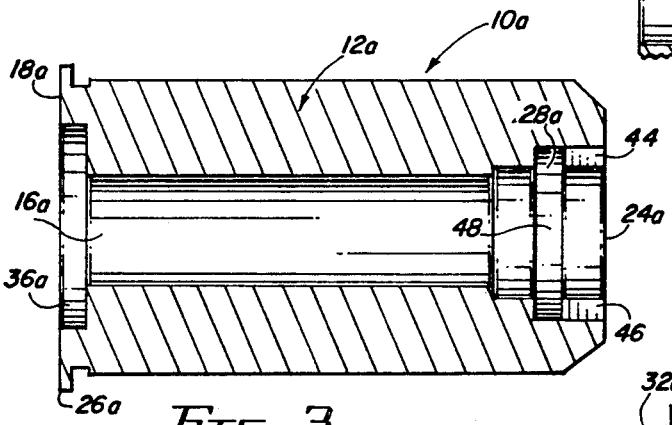
FIG. 3 is a schematic vertical cross-section of a second preferred embodiment of the main body portion of the adapter of the present invention.
Figure 4:
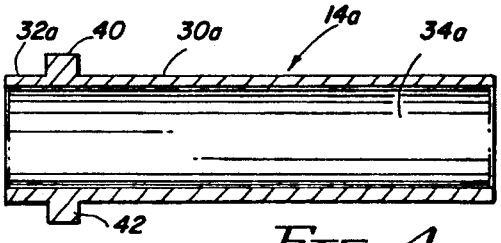
FIG. 4 is a schematic vertical cross-section of a second preferred embodiment of the barrel extension of the invention, as used with the main body of FIG. 3.

A second preferred embodiment of the improved adapter of the present invention is schematically depicted in FIGS. 3 & 4. Thus, adapter 10*a* is shown. Components thereof similar to those of adpater 10 bear the same numerals but are succeeded by the letter "a".

Adapter 10*a* is identical to adapter 10, except as follows:

a) rear portion 30*a* is outfitted with a pair of earns or wings 40 and 42 protruding outwardly from opposite sides of portion 30*a*, and there is no threading on surface 32*a;* b) recess 28*a* is unthreaded. Instead, a pair of longitudinal slots 44 & 46 accept wings 40 and 42, respectively, and terminate at their rear ends in a cylindrical or semi-cylindrical groove 48.

Barrel 14*a* can be quickly connected to main body 12*a* by sliding wings 40 and 42 rearwardly into slots 44 and 46, respectively, until bores 16*a* and 34*a* abut, then rotating barrel 14*a* to move wings 40 and 42 less than a half turn in groove 48 so as to trap wings 40 and 42 in groove 48, thereby releasably holding barrel 14*a* in place in main body 12*a*. This quick connect-disconnect system works very well.

FIGS. 5 & 6

Figure 5:
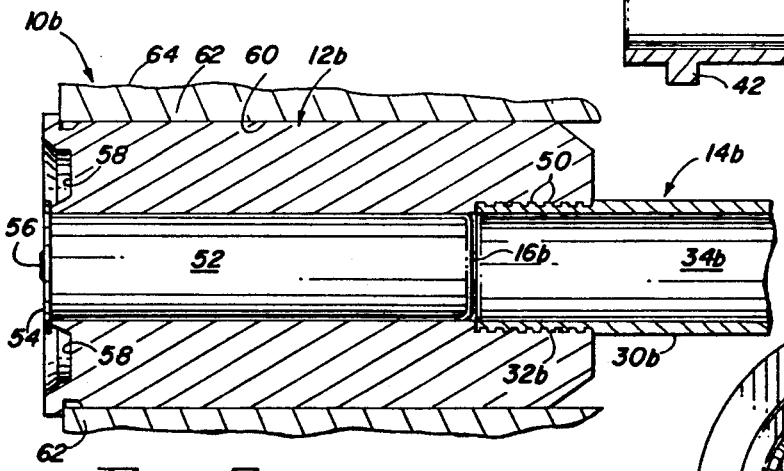
FIG. 5 is a schematic fragmentary vertical cross-section of a third preferred embodiment of the improved adapter of the present invention, shown with a shotgun shell therein in side elevation as the adapter is disposed in the breech and barrel of a shotgun; and, FIG. 6 is a schematic rear elevation of the adapter, shotgun shell and breech of FIG. 5.
Figure 6:
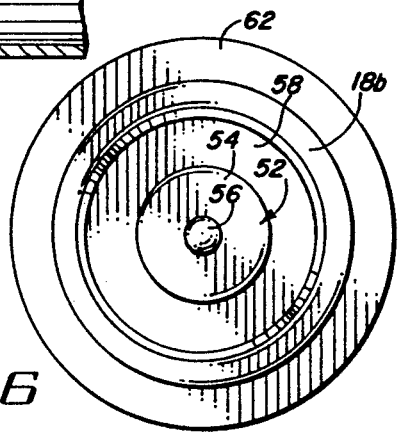

A third preferred embodiment of the improved adapter of the present invention is schematically depicted in FIGS. 5 & 6. Thus, adapter 10*b* is shown. Components thereof similar to those of adapter 10 bear the same numerals but are succeeded by the letter "b".

Adapter 10*b* is substantially identical to adapter 10, except as follows:

a) in place of regular threading, recess 28*b* of main body 12*b* and outer surface 32*b* of rear portion 30*b* of barrel 14*b* have threading 50 which has a pattern of lands and grooves which is generally rectangular in side elevation, so that such threading 50 is non-stripping in nature and cannot cross-thread. Such threading 50 assures rapid and easy connection of barrel 14*b* to main body 12*b* and rapid and easy disconnection thereof from main body 12*b*.

b) shot gun shell 52 is shown in bore 16*b*. Shell 52 has a rim 54 and primer 56. Rim 54 is undercut by an annular groove 58 in rear end 18*b* of main body 12*b* which allows fingers to be inserted in groove 58 to easily seat shell 52 into and remove shell 52 from bore 16*b*. This saves time and effort.

It will be noted in FIGS. 5 & 6 that main body 12*b* is shown slidingly seated into bore 60 of breech 62 of a shot gun or gas gun 64 so that releasably connected barrel 14*b* projects forwardly thereof and into the gun barrel (not shown). Adapter 10*b* has substantially the advantages of adpaters 10 and 10*a*.

Various modifications, changes, alterations, and additions can be made in the improved adapter of the present invention and in its components and parameters. All such modfiications, changes, alterations and additions as are within the scope of the appended claims form part of the present invention.

What is claimed is:

1. An improved shotshell size adapter, said adapter comprising, in combination:

a) a cylindrical main body having a front portion with a front end and a rear portion with a rear end, said main body being solid throughout but having a central cylindrical bore extending therethrough along the longitudinal axis thereof, the main body being adapted to be seated within the bore of a shotgun breech, and said rear end of said adapter bore being adapted to receive a shotgun shell of a preselected size;

b) a cylindrical barrel having a front portion with a front end and a rear portion with a rear end with a preselected central bore extending longitudinally therethrough; and, c) connector means releasably connecting said barrel at said rear end thereof to said front end of said adapter main body, d) wherein the exterior surface of said rear end of said main body has an annular groove spaced outwardly from said bore to provide a finger space to enable a shotshell when seated in said bore to be easily lifted by the fingers from said main body bore.

2. The improved adapter of claim 1 wherein said rear end of said main body has an annular peripheral rim adapted to abut the rear end of a shot gun breech.

* * * * *